US005727887A

United States Patent [19]

Webster et al.

[11] Patent Number: 5,727,887

[45] Date of Patent: Mar. 17, 1998

[54] APPARATUS AND METHOD FOR PERFORMING A WORK OPERATION WITH A CONSUMABLE WEB

[75] Inventors: Ronald B. Webster, Ellington; Daniel J. Sullivan, Hartford; William J. Tortora, West Willington; Joseph W. Stempien, Newington; Dwight Curry, Vernon; David P. Boisvert, Southington, all of Conn.

[73] Assignee: Gerber Scientific Products, Inc., Manchester, Conn.

[21] Appl. No.: 629,362

[22] Filed: Apr. 8, 1996

[51] Int. Cl.[6] ..... B41J 35/28

[52] U.S. Cl. ..... 400/208; 400/611; 400/703; 242/335; 242/344; 242/357; 226/45; 200/61.13; 200/61.15

[58] Field of Search ..... 400/611, 613, 400/208, 703, 249, 88; 242/335, 344, 357; 73/159; 226/45; 200/61.13, 61.14, 61.15, 61.16

[56] References Cited

U.S. PATENT DOCUMENTS

| | | | |
|---|---|---|---|
| 4,623,418 | 11/1986 | Gombrich et al. | 400/88 |
| 4,797,018 | 1/1989 | Hofmann et al. | 400/208 |
| 4,970,531 | 11/1990 | Shimizu et al. . | |
| 5,150,977 | 9/1992 | Yoshikawa | 400/249 |
| 5,318,369 | 6/1994 | Ishii | 400/249 |
| 5,333,960 | 8/1994 | Nam | 400/249 |
| 5,385,416 | 1/1995 | Maekawa et al. | 400/208 |
| 5,605,404 | 2/1997 | Nunokawa et al. | 400/703 |

FOREIGN PATENT DOCUMENTS

| | | |
|---|---|---|
| 60-072777 A | 4/1985 | Japan . |
| 63-084975 A | 4/1988 | Japan . |
| 63-197680 A | 8/1988 | Japan . |
| 63-250284 A | 10/1988 | Japan . |
| 2-024178A | 1/1990 | Japan . |
| 2-116579 A | 5/1990 | Japan . |
| 2-158380 A | 6/1990 | Japan . |
| 2-297474 A | 12/1990 | Japan . |
| 4-062086 A | 2/1992 | Japan . |
| 5-162407 A | 6/1993 | Japan . |

*Primary Examiner*—Eugene H. Eickholt
*Attorney, Agent, or Firm*—McCormick, Paulding & Huber

[57] ABSTRACT

A machine and method of performing a work operation requiring a known or predetermined length of unconsumed web has a cassette containing consumable web material, and the cassette has an indicator for identifying a length of unconsumed web in the cassette. The length of unconsumed web in the cassette is compared to a known or predetermined length of unconsumed web required to perform the work operation, and the operation is performed if the length of unconsumed web in the cassette is at least equal to the required length of unconsumed web. In one embodiment, the indicator takes the form of a potentiometer mounted on an exterior surface of the cassette for electrically indicating the amount of unconsumed web, or a pointer carried by a worm gear rotatably coupled to a spool of the cassette, wherein the pointer moves relative to indicia on the cassette upon rotation of the spool to visually indicate the amount of unconsumed web in the cassette.

23 Claims, 9 Drawing Sheets

APPARATUS AND METHOD FOR PERFORMING A WORK OPERATION WITH A CONSUMABLE WEB

BACKGROUND OF THE INVENTION

The present invention relates generally to apparatus and methods for performing work operations requiring a known or predetermined length of consumable web to perform each work operation, and relates more particularly to such apparatus and methods which utilize a cassette containing the consumable web, and an indicator for identifying the length of unconsumed web in the cassette.

There are numerous types of known equipment and processes for performing work operations requiring a known or predetermined length of consumable web and which utilize cassettes containing the web. For example, in the printing industry there are various types of equipment and processes for printing signs or other products with graphic images requiring a known or predetermined length of consumable web bearing a print medium, and which utilize cassettes containing the web. Generally, a sheet of print-receiving material upon which the printing occurs is passed between a platen and a print head, and a consumable web carrying a print medium is passed between the print head and the sheet. The print medium is transferred from the web to the sheet by some action of the print head, for example heat, to transfer or form images on the sheet. The consumable web typically carries a print medium of a single color, and is wrapped on a pair of spools. As the web is advanced during a printing operation, it is passed from one spool to the other. The web and spools are usually housed in a self-contained cassette that is easily inserted into and removed from the printer to replace or substitute one cassette for another.

During the course of a printing operation, it usually becomes necessary to replace or substitute one cassette for another, either because the cassette does not have enough unconsumed web to perform a particular printing operation, or because a different color print medium is needed. With known printing apparatus, however, neither the printer nor the cassette includes means for indicating the amount of unconsumed web in a cassette. Accordingly, an operator is required to estimate, and in some cases guess as to the amount of unconsumed web in a cassette, which often leads to wasted time, web and/or expense. For example, if a cassette runs out of unconsumed web before a printing operation is completed, the printing must be repeated, if possible, with a new cassette. Typically, it is not possible to interrupt a printing operation, and consequently the printing operation results in a wasted product and web. The further that a particular printing operation has proceeded prior to running put of unconsumed web, the greater the waste. To avoid this situation, an operator may discard a cassette estimated to contain only a short length of unconsumed web, which is otherwise usable in a printing operation that requires less web. Because the web is relatively expensive, this can lead to substantial waste and unnecessary expense.

It is accordingly an object of the present invention to overcome the drawbacks and disadvantages of such prior printing apparatus.

SUMMARY OF THE INVENTION

The present invention is directed to a machine and related method for performing a work operation requiring a predetermined length of consumable web, and a cassette which contains the web, is detachably mounted in the machine and includes visual and/or machine-readable means for indicating the length of unconsumed web in the cassette.

According to one aspect of the present invention, the machine is a printing apparatus for printing signs and other products with graphic images on a sheet of print-receiving material. The printing apparatus includes a cassette containing a consumable web, and a means for indicating the length of unconsumed web in the cassette. A comparator compares the length of unconsumed web in the cassette with a predetermined length required to perform a printing operation, and the operation is performed if the length of unconsumed web is at least equal to the predetermined length.

According to another aspect of the present invention, the means for indicating includes a mechanism provided on the cassette for indicating in machine-readable data the length of unconsumed web in the cassette. The machine includes a pick-up that "reads" the mechanism to establish the length of unconsumed web in the cassette.

According to yet another aspect of the present invention, the means for indicating the length of unconsumed web includes a gauge carried by the cassette. In one embodiment, the gauge includes a worm gear rotatably coupled to a spool carrying the unconsumed web, and a pointer carried by a threaded member coupled to the worm gear for movement in the axial direction of the gear upon rotation of the spool. Indicia are provided on a casing of the cassette, so that as the web is unwrapped from the spool, the threaded member moves along the worm gear, and the pointer moves relative to the indicia to indicate the amount of unconsumed web on the spool.

According to still another aspect of the present invention, the method is for printing signs and other products with graphic images on a sheet of print-receiving material, including the steps of providing a printer for performing a printing operation which consumes a length of web in the course of the printing operation; loading a cassette containing a consumable web into the printer, wherein the cassette includes an indicator for identifying the length of unconsumed web in the cassette; reading the indicator to identify the length of unconsumed web in the cassette before the printing operation is started; comparing the length of unconsumed web in the cassette with a known or predetermined length required to perform the printing operation; and performing the printing operation if the length of unconsumed web is at least equal to the required length. The method of the present invention preferably also includes the step of updating the indicator to indicate a new length of unconsumed web reflecting the amount of web consumed during the respective printing operation.

One advantage of the present invention is that the amount of unconsumed web remaining in a cassette can be rapidly and accurately determined before initiating each printing or other type of work operation. A cassette which does not contain sufficient unconsumed web to perform a particular work operation may therefore be identified and replaced with another cassette containing sufficient web to perform the operation. The cassette that is replaced can be saved for a subsequent printing operation that requires less web. Accordingly, the wasted time, web and/or expense normally associated with prior art printing apparatus is substantially avoided. Additional advantages of the present invention will become apparent in view of the following detailed description and accompanying drawings.

DETAILED DESCRIPTION OF THE PREFERRED EMBODIMENTS

Figure 1:
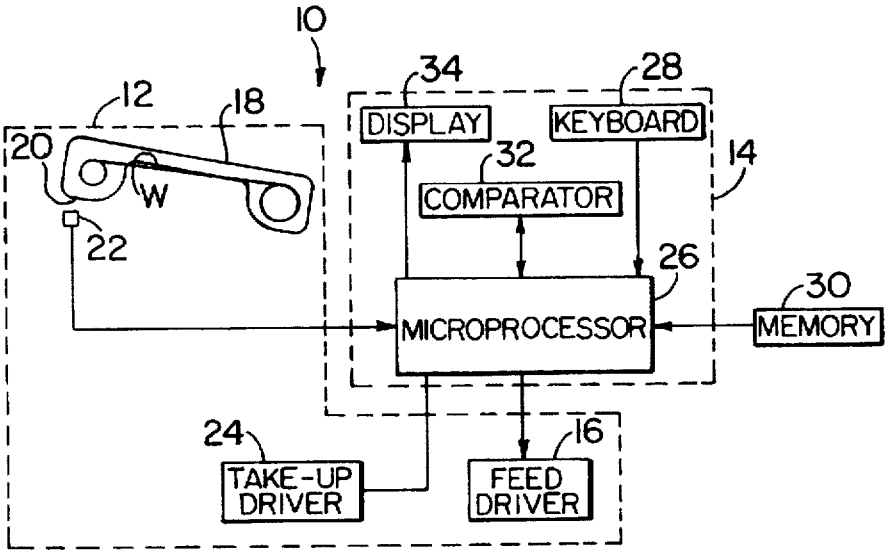
FIG. 1 is a schematic diagram of a machine embodying the present invention for printing signs and other products with graphic images on a sheet of print-receiving material.

In FIG. 1, a machine embodying the present invention is indicated generally by the reference numeral 10. In the embodiment of the present invention illustrated, the machine 10 is employed within a printing apparatus including a printer 12, and a controller 14 for controlling operation of the printer to print signs and/or other products with graphic images on a sheet of print-receiving material ("sheet material"). A typical such apparatus is disclosed in U.S. Pat. Nos. 5,376,953 for a "Thermal Printing Apparatus with Improved Power Supply", issued Dec. 27, 1994, 5,421,261 for a "Printing Apparatus Having Web-Cleaning Members for Removing Particles Affecting Print Quality", issued on Jun. 6, 1995, and co-pending patent application Ser. No. 08/007,662, filed Jan. 22, 1993, entitled "Method And Apparatus For Making A Graphic Product" now U.S. Pat. No. 5,537,135, all assigned to the same Assignee as is the present invention, and which are hereby incorporated by reference as part of the present disclosure. It is noted that although the preferred embodiments are employed in such an apparatus, the present invention may equally be employed in other types of apparatus, as will be evident to those of ordinary skill in the art based upon the disclosure of the present specification.

The printer 12 includes a feed driver 16 for feeding the sheet material through the printer, and a cassette 18 containing a consumable web W carrying a transferable print medium for printing signs and/or other products with graphic images on the sheet material. The cassette 18 includes an indicator 20, which in the present embodiment comprises a potentiometer for identifying the amount of unconsumed web remaining in the cassette, and other information, as is described further below.

The printer 12 also includes a reader 22, which in the embodiment of FIG. 1 comprises an electrical pick-up, for reading the indicator 20 and ascertaining the amount of unconsumed web in the cassette 18. The printer 12 further includes a take-up driver 24 for advancing the web W from one spool of the cassette 18 to another during a printing operation.

The controller 14 includes a microprocessor 26 to regulate the operation of the printer 12, including operation of the feed driver 16 and take-up driver 24. The controller 14 is responsive to inputs from the pick-up 22, a keyboard 28, and a printing program derived from a memory 30, including information identifying a length of unconsumed web required to perform a particular printing operation. The controller 14 also includes a comparator 32 for comparing the length of unconsumed web in a cassette to the required length for performing each respective printing operation, to ensure that there is enough unconsumed web to perform each operation. If there is insufficient unconsumed web in a cassette, the controller 14 signals the operator via a display 34, and inhibits commencement of the printing operation.

Figure 2:
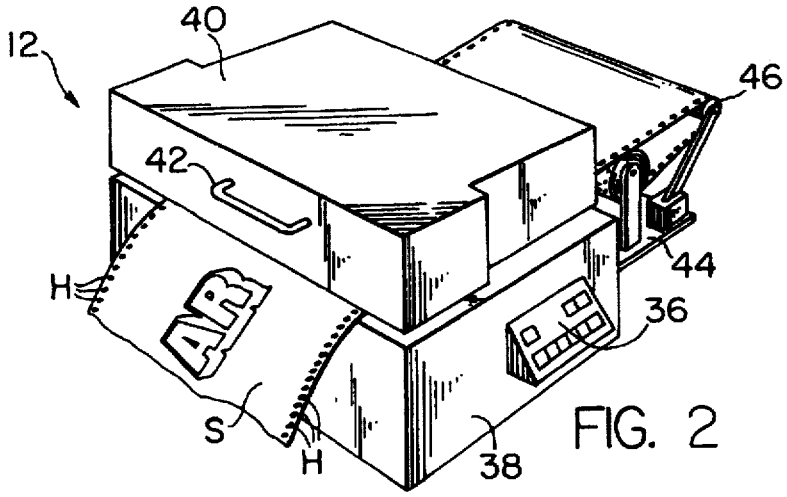
FIG. 2 is a perspective view of a printer which forms part of the machine of FIG. 1.

Turning to FIG. 2, the printer 12 includes a control panel 36 having controls for slewing a strip S of sheet material independently of a printing operation, as well as other controls for the printer. A printer housing 38 includes a cover 40, which is pivotally mounted on top of the housing and can be opened and closed by gripping a handle 42 to access the internal structure of the printer.

The strip S of sheet material defines feed holes H along each longitudinal edge of the strip, is supplied on a roll supported by a platform 44 located on the back side of the printer 12, and is fed over a guide roller 46 before it enters the housing 38 of the printer. In the embodiment of the present invention illustrated, the sheet material S is a vinyl sheet secured by a pressure-sensitive adhesive on a releasable backing, but as will be recognized by those skilled in the pertinent art, may be of any of numerous types of known print-receiving sheet materials.

Upon passage through the printer 12, characters and/or graphic images are printed on the strip S, and the strip is then discharged freely through the front side of the printer, or may be retrieved on a take-up roll (not shown) if desired. A cutter (not shown), which includes a set of sprockets to engage the feed holes H, cuts the strip S along the peripheral edges of the characters and/or graphic images and any internal edges in accordance with a cutting program. After weeding to remove unwanted material within or around the characters and/or graphic images, the vinyl upon which the characters and/or graphic images are formed is lifted from the underlying backing material and attached to a sign board, window or other suitable object.

Figure 3:
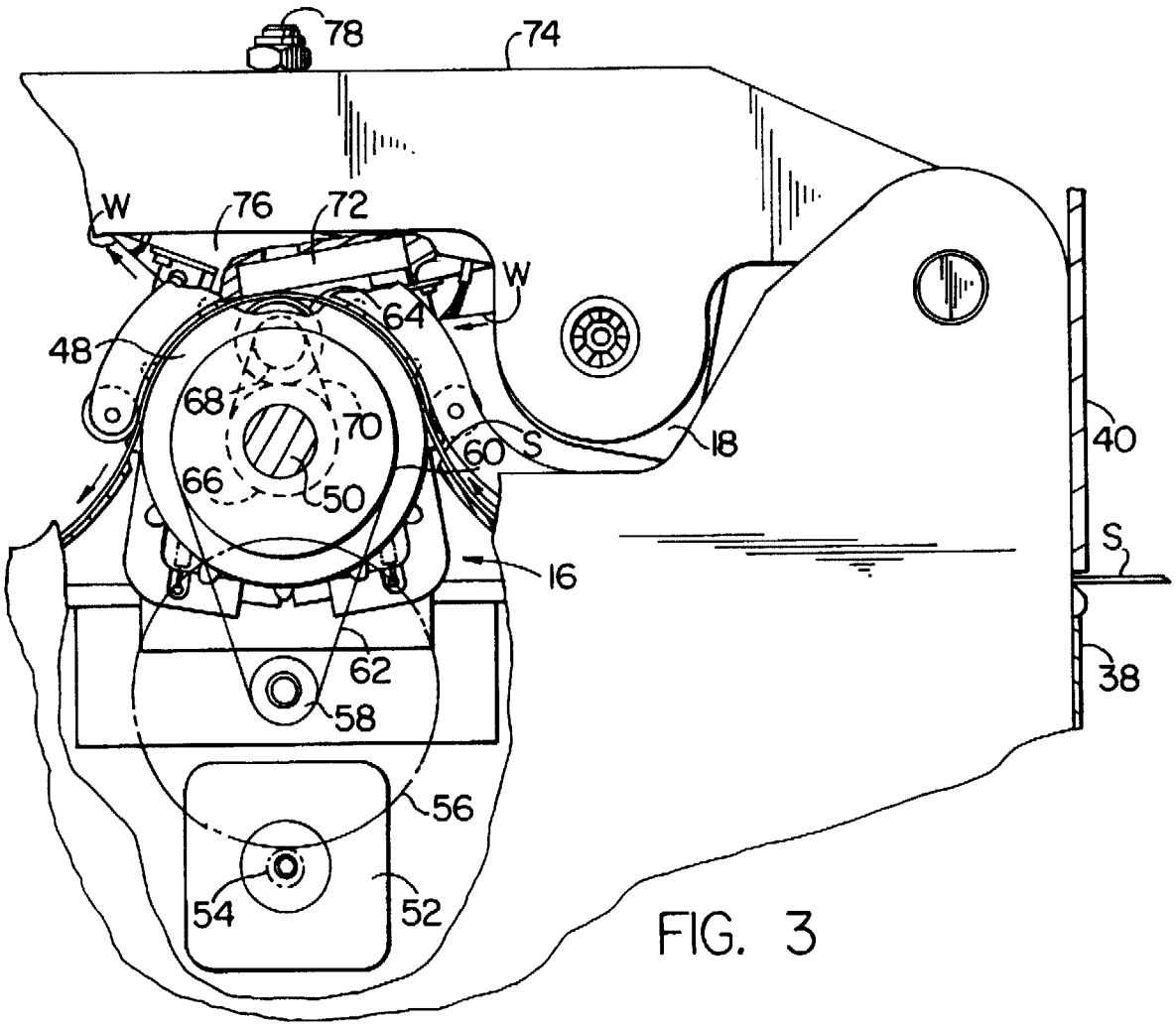
FIG. 3 is a side elevation view of the printer of FIG. 2 in partial cross section and with parts broken away, illustrating a feed drive mechanism for feeding a sheet of print-receiving material through the printer.

Turning to FIG. 3, the feed driver 16 for feeding the strip S through the printer includes two drive sprockets 48 (one shown), each of which is fixedly mounted to a respective end of a drive shaft 50. The drive shaft 50 is rotatably mounted within the housing 38, and is driven from a stepping motor 52 by a series of drive gears 54,56 (shown in phantom), toothed drive pulleys 58,60, and a toothed drive belt 62.

As shown partially in phantom in FIG. 3, a roller platen 64 is also rotatably mounted within the housing 38, and is driven at one end from the drive shaft 50 by two drive pulleys 66,68, and a drive belt 70 coupled between the two drive pulleys. The roller platen 64 is also driven at the other end by an identical drive pulley and belt arrangement (not shown). Each of the platen drive pulleys 66,68 is selected to establish a peripheral speed of the roller platen 64 slightly greater than the peripheral speed of the drive sprockets 48, to augment the feeding of the strip S through the printer.

The outer surface of the roller platen 64 is defined by a hard rubber sleeve, and a marginal portion of the strip S defining the feed holes H overlaps the rubber sleeve at each end. Since the drive sprockets 48 positively engage the strip S and control the speed of the strip, each drive belt 70 allows limited slip to prevent tearing of the strip S due to a difference in peripheral speeds of the drive sprockets 48 and the platen drive pulleys 66,68.

Figure 4:
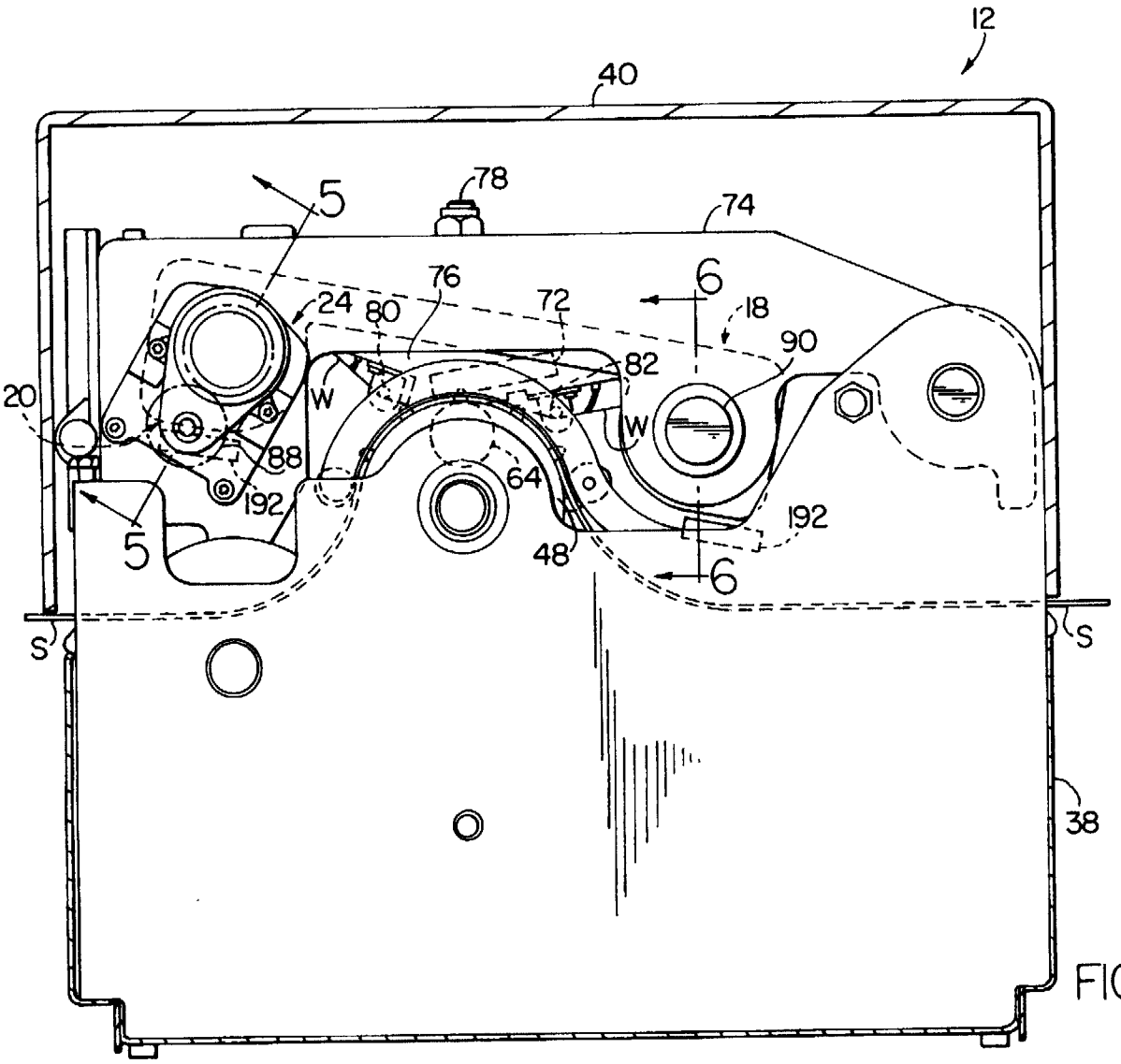
FIG. 4 is a side elevation view of the printer of FIG. 2 in partial cross section and with parts broken away, illustrating in partial phantom the manner in which a cassette embodying the present invention is detachably mounted in the printer.

As shown in FIGS. 3 and 4, the strip S passes between the roller platen 64 and a thermal print head 72, which is pressed downwardly onto the strip S, and establishes a generally linear zone of contact between the strip and the roller platen. Each of the drive sprockets 48 defines a set of sprocket pins, several of which are illustrated partially in phantom in FIGS. 3 and 4, which engage the feed holes H along a respective marginal edge of the strip S. The print head 72 has a plurality of heating elements (not shown) distributed evenly along the print head from one end of the roller platen 64 to the other, and the heating elements are densely packed along the zone of contact.

As best shown in FIG. 4, a frame 74 is pivotally mounted within the housing 38, and carries an upper support member 76 by means of a series of bolts 78 (one shown). The upper support member 76 in turn supports a pair of dancer rolls 80,82 (shown in phantom) to guide the web W across the roller platen 64. The web W carries a transferable print medium, such as a heat sensitive printing ink or dye in black, white or other color, on a surface of the web facing the strip S. When the heating elements of the print head 72 are selectively energized, the portion of the ink immediately under an energized heating element is released from the web and transferred to the strip S. The selective energization of the heating elements is directed by the controller 14 in accordance with the printing program derived from the memory 30, to create characters and/or graphic images on the strip S.

Since the ink is transferred from the web W to the strip S, the web is referred to as a donor web, which is expended after a single use and must therefore be periodically replaced. In addition, a typical web includes a transfer ink of only a single color, and in order to print graphic images in multiple colors, it is necessary to run the printing operation one or more times with different colored webs. The cassette 18, shown in an installed position in FIG. 4, is therefore easily removable from the printer 12 to replace or substitute one cassette for another.

Figure 7:
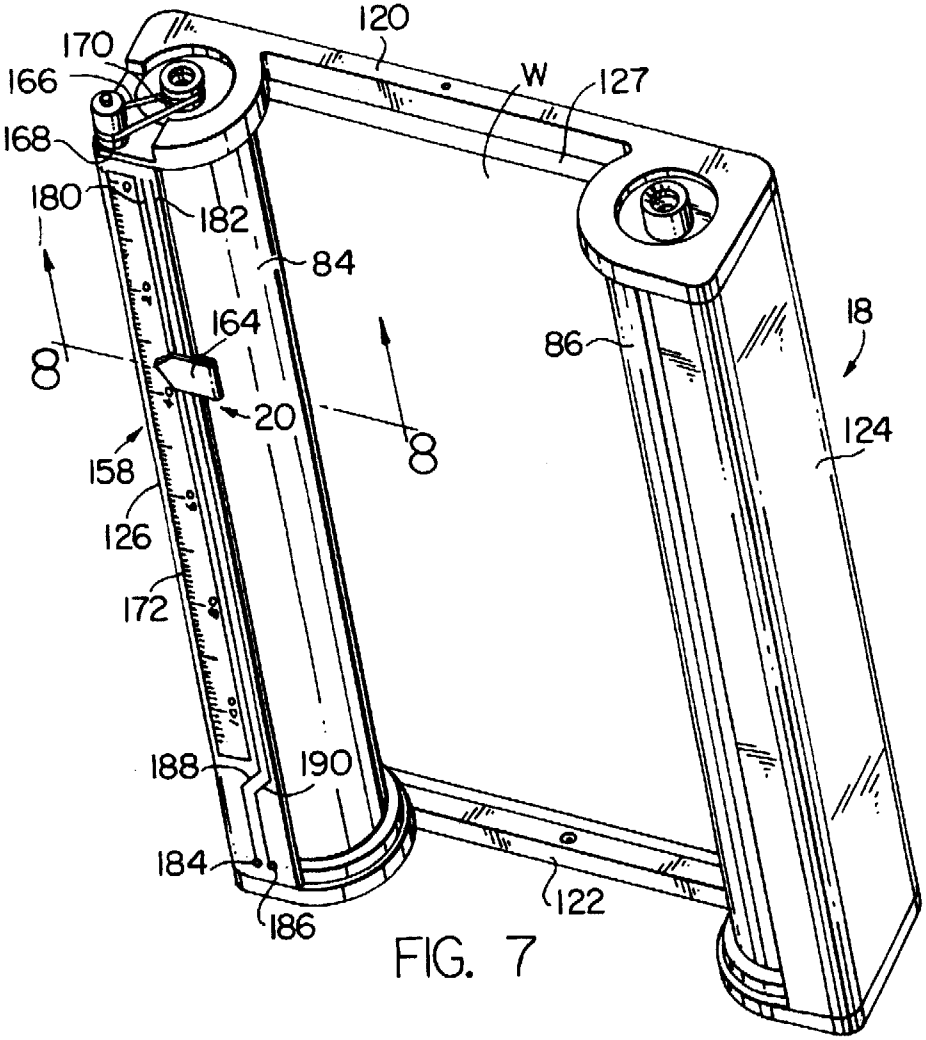
FIG. 7 is a fragmentary, perspective view of a first embodiment of a cassette of the present invention used in the printer of FIG. 2, including an indicator in the form of a potentiometer and visual indicia for indicating the amount of unconsumed web in the cassette.

As shown in FIG. 7, the cassette 18 includes two spools, a supply spool 84 for carrying the unconsumed web W, and a take-up spool 86 for carrying the consumed web after it is passed beneath the print head 72 during a printing operation. With respect to FIG. 4, the take-up driver 24 preferably includes a DC motor 88, although a servo-motor or other type of motor may also be employed, which operates under control of the controller 14 and is coupled to the take-up spool of the cassette 18. The DC motor 88 is operated only during a printing operation, and rotatably drives the take-up spool 86 (FIG. 5) to collect the web W passed between the print head 72 and roller platen 64 during the printing operation. When the strip S is slewed, on the other hand, the DC motor 88 is de-energized, so that the web W is neither advanced nor consumed.

As shown in FIG. 4, the take-up driver 24 also includes a drag clutch assembly 90 coupled to the supply spool of the cassette 18. The drag clutch assembly 90 offers a resistance to rotation of the supply spool, so that during a printing operation the web W is under a slight tension to facilitate a smooth passage of the web between the print head 72 and strip S.

Figure 5:
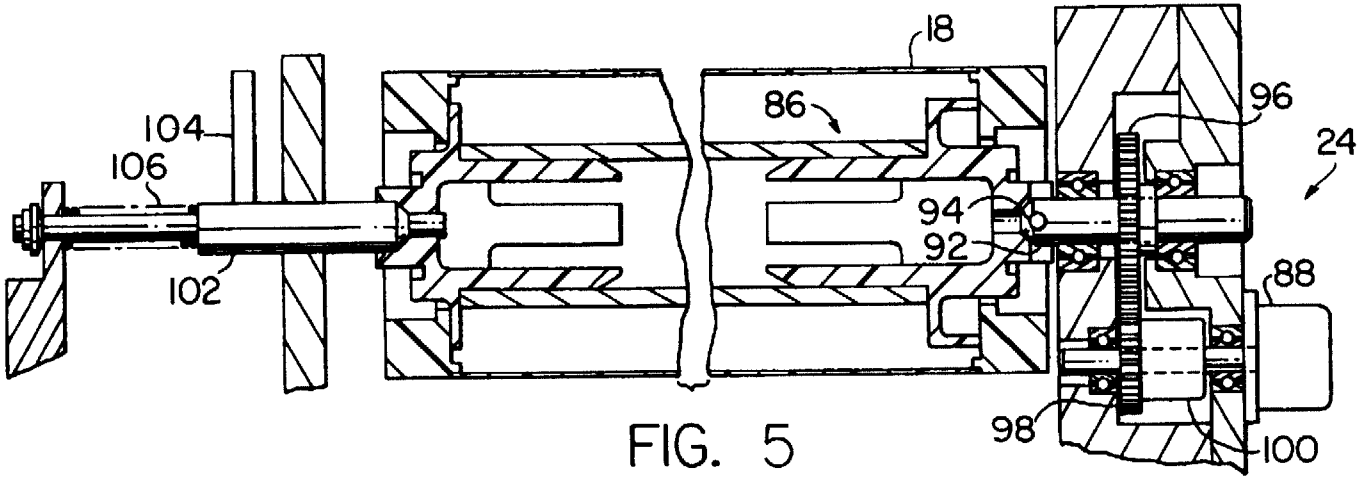
FIG. 5 is a fragmentary, cross-sectional view taken along the line 5—5 of FIG. 4, illustrating a drive mechanism and support structure for a take-up spool of the cassette shown in FIG. 4.

Turning to FIG. 5, one axial end of the take-up spool 86 is mounted on a rotatable axle 92 and prevented from rotation relative to the axle by a cross pin 94. The axle 92 in turn is coupled through a set of gears 96,98, or in the alternative a pair of pulleys coupled by a belt, and a slip clutch 100 to the DC motor 88. Hence, when the DC motor 88 is energized, it applies a torque, which is limited by the slip clutch 100, to rotatably drive the take-up spool. The other end of the take-up spool 86 is mounted on a non-rotatable and retractable axle 102. As shown in FIG. 5, the axle 102 is normally biased into engagement with the end of the take-up spool 86 by a compression spring 106. A release lever 104 is fixed to the axle to permit the axle to be retracted against the spring by pulling the lever toward the spring, and in turn release the take-up spool and cassette from the printer.

As noted above, during a printing operation, the web W is superimposed over the strip S, and both are pressed between the print head 72 and roller platen 64 to move synchronously through the printer. The slip clutch 100 allows for sufficient slippage so that the rate of advancement of the web W is substantially the same as that of the strip S as the two are passed between the roller platen and print head.

Figure 6:
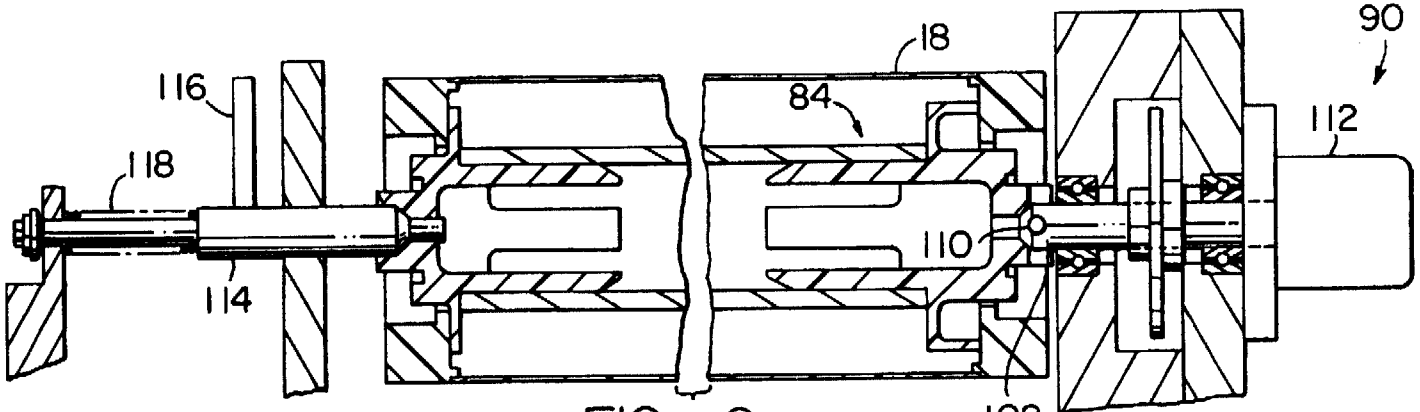
FIG. 6 is a fragmentary, cross-sectional view taken along the line 6—6 of FIG. 4, illustrating a support structure for a supply spool of the cassette shown in FIG. 4.

Turning to FIG. 6, one axial end of the supply spool 84 is mounted to one end of a rotatable axle 108 and prevented from rotation relative to the axle by a cross pin 110 received within the end of the spool. The other end of the other rotatable axle 108 is coupled to a drag clutch 112, which imposes a frictional restraint on the supply spool 84 as the unconsumed web W is unwrapped from the spool during a printing operation. The other end of the supply spool 84 is mounted on a non-rotatable and retractable axle 114. As shown in FIG. 6, the axle 114 is normally biased into engagement with the end of the supply spool 84 by a compression spring 118. A release lever 116 is fixed to the axle to permit the axle to be retracted against the spring by pulling the lever toward the spring, and in turn release the supply spool and cassette from the printer.

Figure 8A:
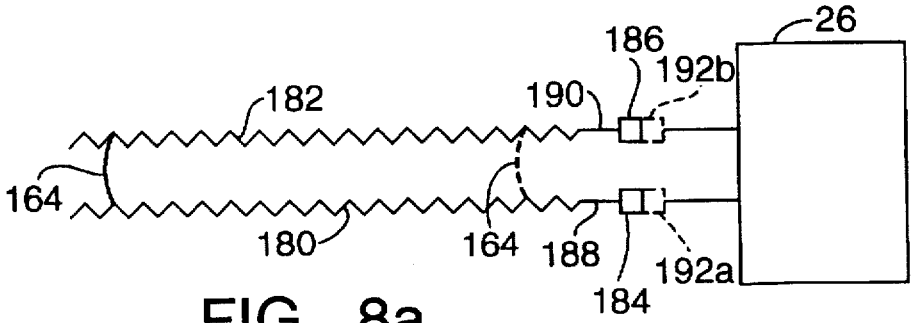
FIG. 8*a* is a schematic diagram of a circuit for using the potentiometer to generate a signal to determine the amount of unconsumed web in the cassette.
Figure 8:
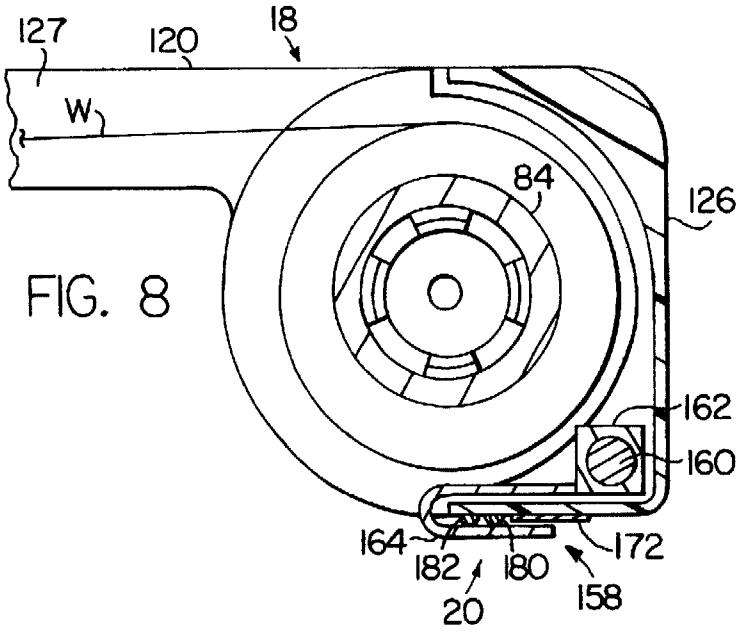
FIG. 8 is a fragmentary, sectional view of the cassette taken along the line 8—8 of FIG. 7.

With reference to FIGS. 7 and 8, the cassette 18 includes two molded side rails 120,122 and two end shells 124,126 forming a rectangular configuration and defining a central opening 127 within which, as shown in FIG. 4, the print head 72 is received in order to press the web W against the roller platen 64. One end of the web W is mounted on the take-up spool 86 enclosed within the end shell 124, and the other end is mounted on the supply spool 84 enclosed within the end shell 126.

As shown typically in FIG. 7, the ends of the take-up spool 86 are loosely supported within a pair of aligned holes, which are each defined by a respective side rail 120 or 122. The supply spool 84 is also loosely supported at its ends within another pair of aligned holes, which are also each defined by a respective side rail 120 or 122. When the cassette 18 is mounted in the printer, each of the spools 84,86 is permitted to rotate freely under the control of the printer.

As shown in FIGS. 7 and 8, the indicator 20 includes a gauge 158 with a potentiometer for electrically identifying, when the cassette is mounted in a printer, the length of unconsumed web W carried on the supply spool 84 of the cassette, and is attached to the exterior surface of the end shell 126 of the cassette. The indicator 20 may alternatively be located adjacent to the take-up spool. As shown in FIG. 4, the potentiometer 20 is positioned on the exterior surface of the cassette and is coupled to the pick-up 192 when the cassette is mounted within the printer, in order to "read" the resistance of the potentiometer.

As best shown in FIGS. 7 and 8, the gauge 158 includes a first threaded member 160 such as a lead screw or worm gear, which is mounted for rotation within the end shell 126 of the cassette 18. The lead screw 160 is driven by a belt 166, which extends around a groove 168 at one end of the lead screw and a groove 170 at the corresponding end of one of the spools, and preferably the end of the supply spool 84, to rotate the lead screw 160 upon rotation of the supply spool 84. With reference to FIG. 8, a nut 162 is coupled to the lead screw 160, and carries a pointer 164 which moves parallel to the axis of rotation of the supply spool 84 as the supply spool rotates.

A pair of resistive strips 180, 182 are provided by screen printing directly, or by some other manner, on the cassette. As illustrated, the strips 180, 182 are provided on the end shell 126 of the cassette 18 adjacent to the supply spool 84. The strips 180, 182 are generally parallel to one another, and extend along the end shell 126 in a direction generally parallel to a path traveled by a nut 162 and pointer 164 of FIG. 8 as the web W is unwound from the supply spool 84. While each strip 180, 182 is illustrated extending in a straight line, each strip is preferably a "saw tooth" pattern or other pattern that extends generally in a straight line. The pointer 164 is electrically conductive, and as best shown in FIG. 8, and is biased into engagement with the strips 180, 182.

The strips 180, 182 terminate at electrical contacts 184, 186 via leads 188, 190, which are coupled to conventional electrical pick-ups (not shown in FIGS. 7 and 8) in the printer when the cassette is installed in the printer. Those skilled in the art will note that the contacts can be positioned anywhere on cassette 18. With reference to FIG. 4, the electrical pick-ups 192 are provided in the printer 12 adjacent to the position of, and in electrical contact with the electrical contacts 184,186 of an installed cassette. The processor 26 (FIG. 1) uses input and output signals to and from the contacts 184,186 in a conventional manner to determine the resistance of the strips, from which the length of unconsumed web remaining in the cassette 18 is determined. The resistance is preferably calibrated so as to accurately indicate the unconsumed web W toward the end of the useful life of the cassette. The embodiment illustrated in FIGS. 7 and 8 has the advantage of visually indicating the length of unconsumed web W in the cassette, as well as providing a machine-readable indicator for indicating the length.

A schematic diagram of the above-described circuit for determining the resistance of the strips 184, 186, and thus the amount of unconsumed web in the cassette, is illustrated in FIG. 8*a*. The circuit includes the resistive strips 180, 182, respective leads 184, 186 and contacts 188, 190 of cassette (not shown), which are electrically connected through the pickups 192*a*, 192*b* to the processor 26. As web is consumed, the pointer 164 is moved from the position illustrated by a solid line in FIG 8*a* to the position indicated by the dashed line, which reduces the resistance provided by the strips 180, 182. As will be recognized by those skilled in the art, when the contacts 188, 190 of a cassette are disconnected from the pickups, the resistance of the open circuit is infinite and the processor 26 generates a signal indicative of no cassette in the printer.

In accordance with the method of the present invention, and with reference to FIG. 1, prior to the commencement of a printing operation, information identifying the length of unconsumed web W required to perform a printing operation is computed from a printing program derived from the memory 30. The microprocessor 26 reads the information from the memory 30, and a corresponding signal indicative of the length of unconsumed web W required to perform the printing operation is transmitted to the comparator 32.

As described above, the indicator 20 of the cassette 18 provides a machine-readable indicator for indicating the length of unconsumed web W in the cassette. Accordingly, as shown in FIG. 4, when each cassette 18 is inserted into the printer 12, the pick-ups 192 read the potentometer 20 and ascertain the length of unconsumed web in the cassette. With reference to FIG. 1, the pick-ups 22 provide a signal indicative of the length of unconsumed web to the microprocessor 26, which in turn sends a corresponding signal to the comparator 32.

The comparator 32 then compares the signal indicative of the length of unconsumed web with the signal indicative of the length of unconsumed web required to perform the printing operation, and sends a signal indicative of the comparison result to the processor 26. If the length of web in the cassette is at least equal to the length of web required to perform the particular printing operation, the microprocessor 26 commences and regulates the printing operation in accordance with the printing program, including operation of the feed driver 16 and the take-up driver 24, to print characters and/or graphic images on the sheet material S.

If, on the other hand, the comparator 32 determines that there is insufficient unconsumed web in the cassette 18 to perform a printing operation, the microprocessor 26 does not commence the printing operation. An error signal indicative of this condition is transmitted to the operator via the display 34 and/or by an audio signal to replace the cassette with insufficient web with another cassette. Upon installation of the next cassette, the reading and comparing steps are repeated and the cassette is replaced, if necessary, until a cassette with sufficient web to perform the printing operation is installed. During a printing operation, the indicator 20 is updated to accurately identify the length of unconsumed web W in the cassette 18.

Figure 9:
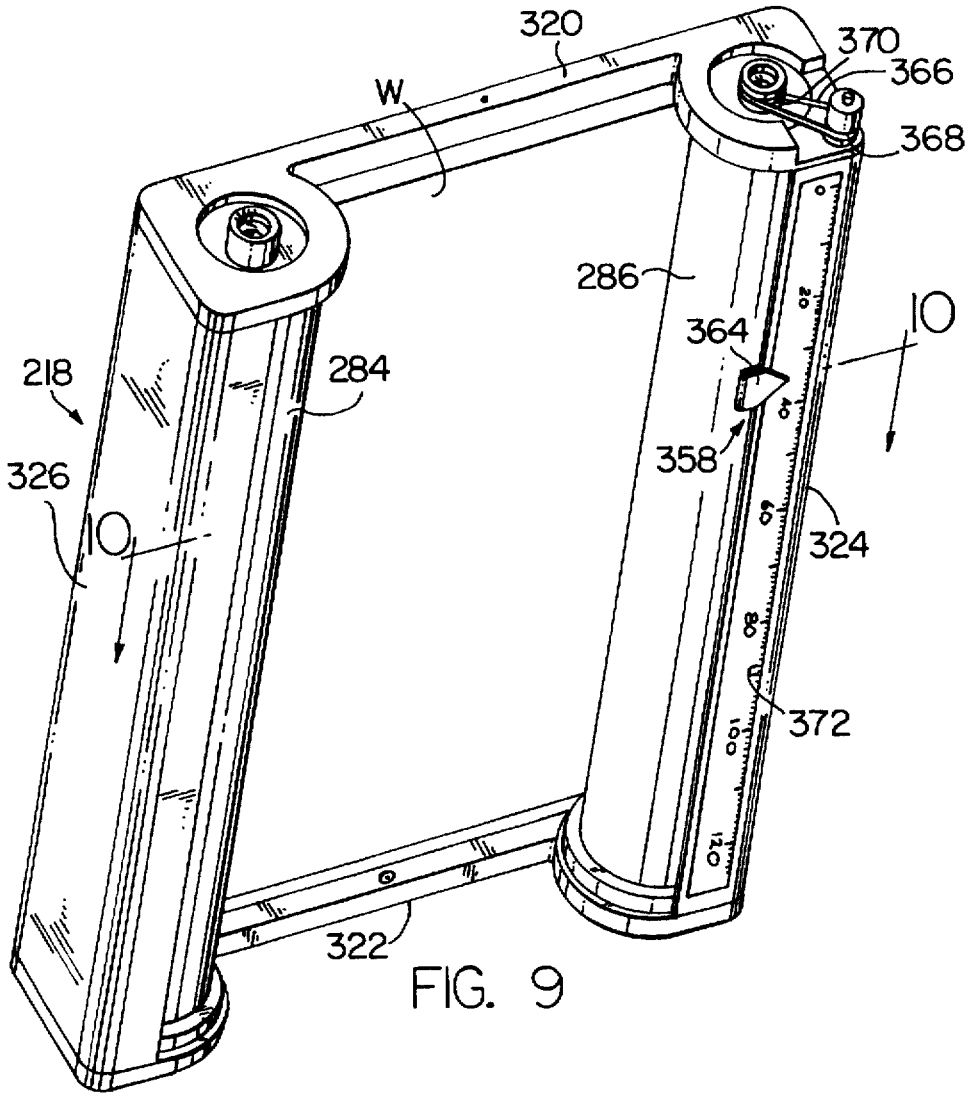
FIG. 9 is a perspective view of a second embodiment of a cassette of the present invention used in the printer of FIG. 2, including a pointer and corresponding indicia on the cassette for visually indicating the amount of unconsumed web in the cassette.
Figure 10:
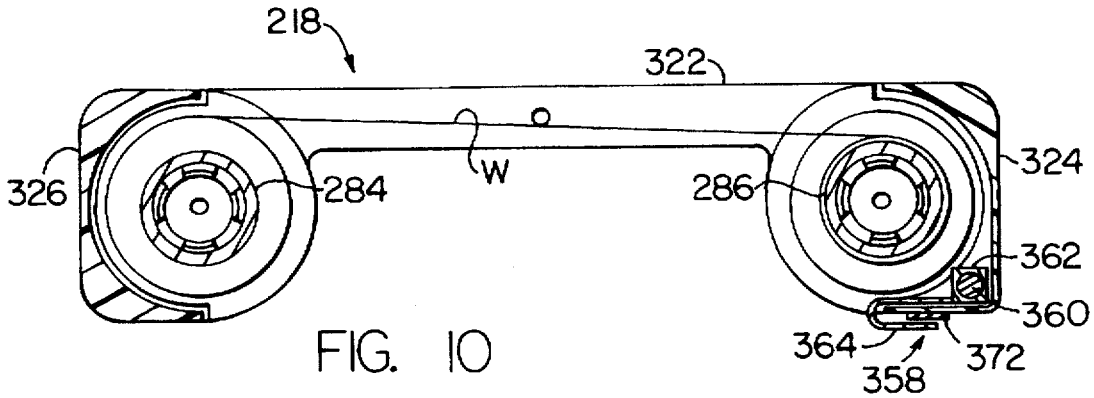
FIG. 10 is a sectional view taken along the line 10—10 of FIG. 9, illustrating a worm gear assembly for moving the pointer.

In FIGS. 9 and 10, another embodiment of a cassette of the present invention is indicated generally by the reference number 218. The cassette 218 is used with the printer 12 described above or like printing apparatus, and is the same in many respects as the cassette 18 described above. Accordingly, like reference numerals preceded by the numerals 2 and 3, instead of 0 and 1, respectively, are generally used to indicate like elements. The cassette 218 differs from the cassette 18 described above in that it only includes means for visually indicating the length of unconsumed web W remaining in the cassette.

As illustrated in FIGS. 9 and 10, the cassette 218 includes a gauge 358 coupled to the take-up spool 286 for visually indicating the amount of unconsumed web in the cassette. If the web W is of the type which wrinkles when it passes between a print head and a roller platen, as are typical webs, those skilled in the art will recognize that it is preferable to couple the gauge to the supply spool, as the initial loading of the web onto the supply spool can be controlled. Preferably, the gauge 358 provides a direct reading of the amount of unconsumed web W wrapped on the supply spool 284, but alternatively, the gauge may equally provide a reading of the length of consumed web wrapped on the take-up spool 286.

The gauge 358 includes a first threaded member 360, such as a worm gear or a lead screw, which is rotatably mounted within the end shell 324 of the cassette, and is illustrated as being coupled to the take up spool by a belt 366 seated within a groove 368 formed in one end of the worm gear and a groove 370 formed in the adjacent end of the take up spool for rotation of the worm gear with the take up spool. As shown in FIG. 10, a second threaded member 362, such as a nut, carries a pointer 364 and is coupled to the worm gear 360 for movement in the axial direction on the worm gear upon rotation of the gear and the spool. The gauge 358 also includes a bar or pad bearing indicia 372, which is attached, printed or otherwise formed on the external surface of the end shell 324 and extends in the axial direction of the take-up spool and worm gear adjacent to the pointer 364. As shown in FIG. 9, the indicia is calibrated to cooperate with the pointer and accurately indicate the length of unconsumed web in the cassette 218.

As the web W is passed from the supply spool 284 to the take-up spool 286 during a printing operation, the take-up spool rotatably drives the worm gear 360, which in turn moves the pointer 364 relative to the indicia 372 to indicate the amount of web passed from one spool to the other, and thus the amount of unconsumed web remaining in the cassette. As will be recognized by those skilled in the art, the indicia on the cassette may alternatively be calibrated to reflect the amount of consumed web in the cassette.

The cassette 218 operates in a printer, such as the printer 12 described above, in a manner similar to the manner described above except that there are no electrically resistive members. With respect to FIG. 1, prior to commencement of a printing operation, a printing program computes a predetermined length of unconsumed web required to perform the printing operation, and the length is indicated on the display 34. A cassette 218 containing a web W bearing a desired color of ink is then selected, and the gauge 358 is read to ascertain the length of unconsumed web in the cassette. If there is sufficient web to perform the printing operation, the cassette is inserted into the printer in the same manner as the cassette 18 described above, and the printing operation is commenced by manipulating the appropriate controls on the control panel 36.

During the printing operation, the feed driver 16 and take-up driver 24 advance the web W from the supply spool 284 to the take-up spool 286 in the cassette. As the take-up driver 24 rotates the take-up spool, the worm gear 360 rotates, and in turn carries the nut 362 and pointer 364 in the axial direction relative to the indicia 372 to indicate the length of unconsumed web W remaining in the cassette.

Figure 11:
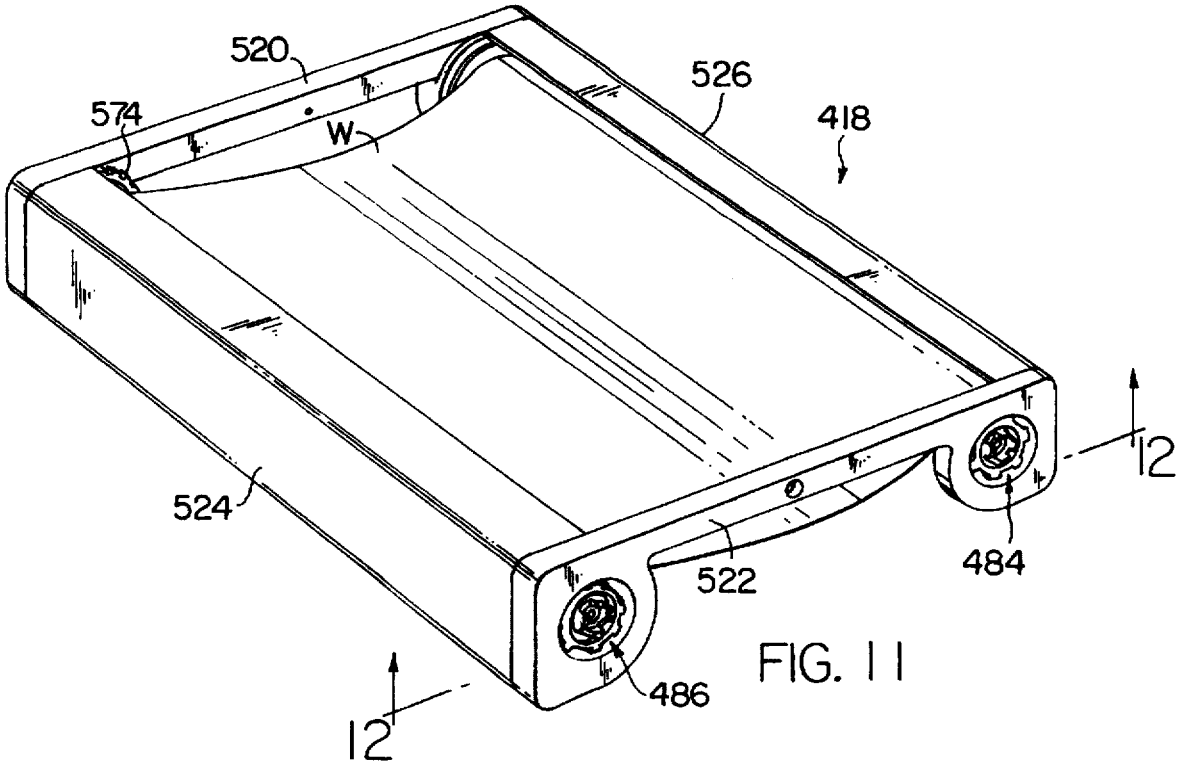
FIG. 11 is a perspective view of a third embodiment of a cassette of the present invention used in the printer of FIG. 2, including a pointer and corresponding indicia to indicate the length of unconsumed web.
Figure 12:
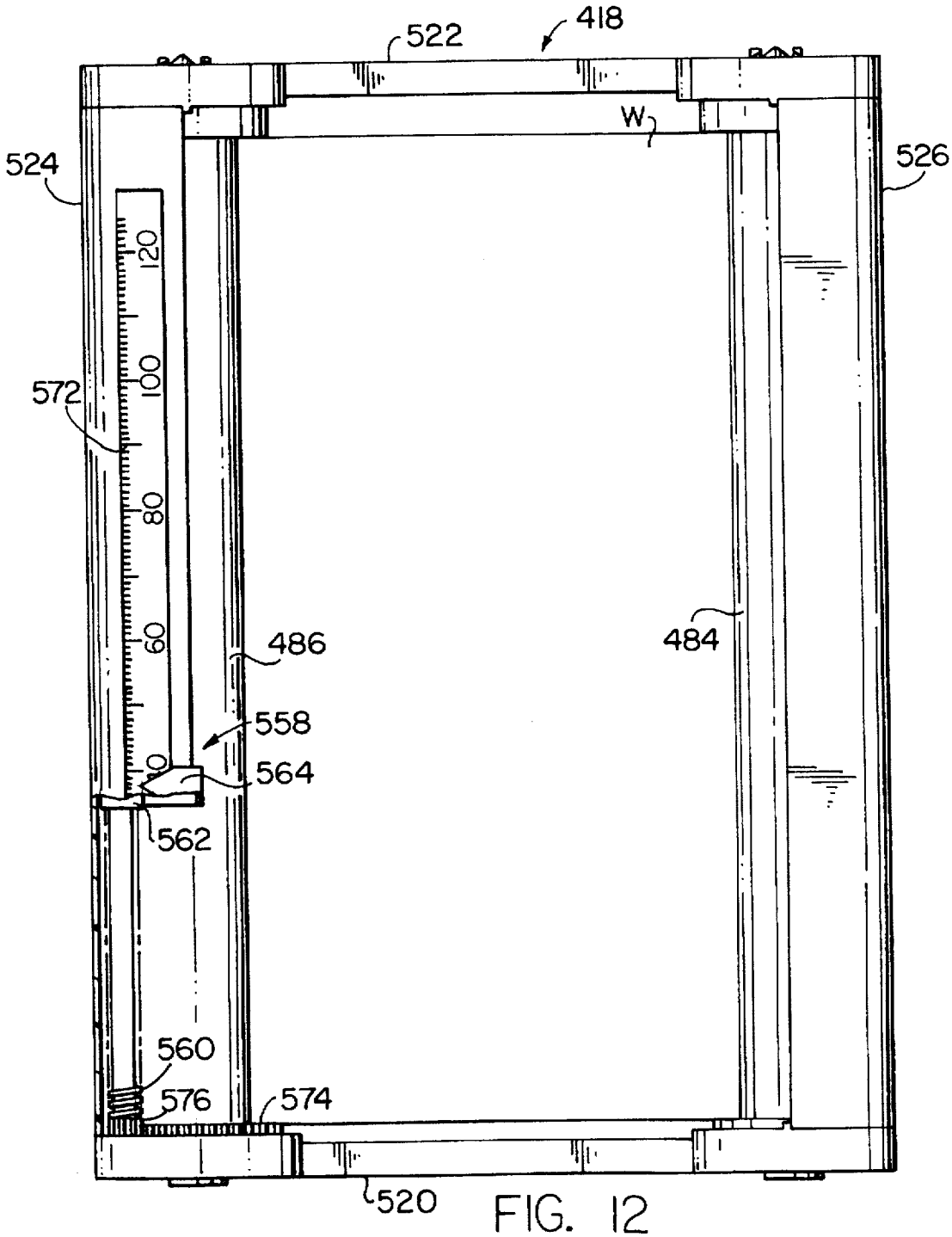
FIG. 12 is a bottom view of the cassette taken along the line 12—12 of FIG. 11, illustrating the indicia and an alternative worm gear assembly for moving the pointer.

Turning to FIGS. 11 and 12, another embodiment of a cassette of the present invention is indicated generally by the reference numeral 418. The cassette 418 is used within the printer 12 described above or like printing apparatus, and is the same in many respects as the cassettes 18 and 218 described above. Accordingly, like reference numerals preceded by the numerals 4 and 5, instead of 0 and 1, and 2 and 3, respectively, are generally used to indicate like elements. The cassette 418 differs from the cassette 18 described above in that like the cassette 218, the cassette 418 includes means for visually indicating the length of unconsumed web W remaining in the cassette, rather than a resistive strip or other device containing machine-readable data as described above. The cassette 418 differs from the cassette 218, however, in that the worm gear is driven from a take-up spool by a set of gears rather than by a belt. More specifically, a first gear 574 is mounted on one end of the take-up spool 486, and a second gear 576 is mounted on the adjacent end of the worm gear 560 and meshes with the first gear. Accordingly, as the take-up spool 486 is rotated during a printing operation, the first gear 574 rotates the second gear 576, and in turn rotatably drives the worm gear 560 to move the pointer 564 relative to the indicia to indicate the amount of unconsumed web in the cassette.

In an alternative embodiment of the indicator, a movable sensor (not shown) is provided in the printer 12, and in conjunction with a cassette having a pointer as described above, determines the length of unconsumed web remaining in a cassette. An optically readable character, such as is shown and described in above-noted U.S. patent application Ser. No. 08/007,662 now U.S. Pat. No. 5,537,135 is positioned on the pointer. The sensor, which is also shown and described in U.S. patent application Ser. No. 08/007,662 , now U.S. Pat. No. 5,537,135, is mounted in a conventional manner along a path parallel to that traveled by the pointer, such as by a lead screw. When a cassette is inserted into the printer and prior to commencement of a printing operation, the sensor is moved from an initial point until the sensor detects the optical character, and thus the position of the pointer. The microprocessor then determines, from signals based upon the position of the pointer, or from the distance traveled by the sensor from a starting reference point to the pointer, the length of unconsumed web remaining in the cassette.

Figure 13:
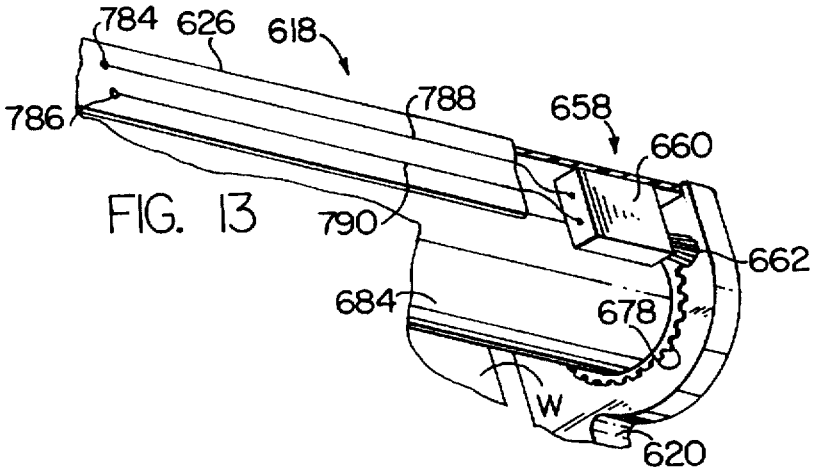
FIG. 13 is a fragmentary, perspective view of a fourth embodiment of a cassette of the present invention used in the printer of FIG. 2, which cassette is similar to the cassette illustrated in FIGS. 7 and 8, and including an alternate potentiometer.

FIG. 13 illustrates another embodiment of a cassette 618 that is similar to the embodiment illustrated in FIGS. 7 and 8 in that the cassette includes means for electrically indicating the length of web remaining in the cassette. The cassette 618 is used within the printer 12 described above or like printing apparatus, and is the same in many respects as the cassettes 18, 218 and 418 described above. Accordingly, like reference numerals preceded by the numerals 6 and 7, instead of 0 and 1, 2 and 3 and 4 and 5, respectively, are generally used to indicate like elements. The cassette 618 differs from each of the cassettes described above in that the cassette 618 only includes means for electrically indicating the length of unconsumed web W remaining in the cassette. The cassette 618 is similar to the cassette 418, however, in that the means for indicating the length of unconsumed web W is driven by a gear 678 attached to a supply spool 684, although it will be recognized by those skilled in the art that alternate drive means, such as the belt and pulley described above may be employed with equal effect.

As noted above, means for electrically indicating, shown generally at 658, the amount of unconsumed web W are provided and preferably include a multi-turn potentiometer 660. The potentiometer 660 includes a reduction gear 662 coupled to the gear 678, which in turn is attached to and rotates with the supply spool 684. The potentiometer 660 is of a type known in the art, such as a Series 343 from Clarostat of Dover, N.H. a model 3005 from Bourns of Riverside, Calif., or an R-Series from Allen Bradley and Almo Electronics Corp. of Philadelphia, Pa. The potentiometer 660 is electrically coupled to contacts 784,786 by electrically-conductive strips 788, 790. As the supply spool 684 is rotated and unconsumed web W is consumed during a printing operation, the gear 678 rotates the reduction gear 662, and alters the resistance of the potentiometer 860.

Again with reference to FIG. 4 and as described above, conventional electrical pick-ups, indicated schematically at 192 are mounted in the printer 12 adjacent to the position of, and are electrically coupled to the electrical contacts 784, 786 when the cassette 618 is mounted within the printer. The processor 26 (FIG. 1) uses input and output signals in the above-described manner to calculate the resistance between the contacts 784,786 in order to ascertain the length of remaining web W.

Figure 14:
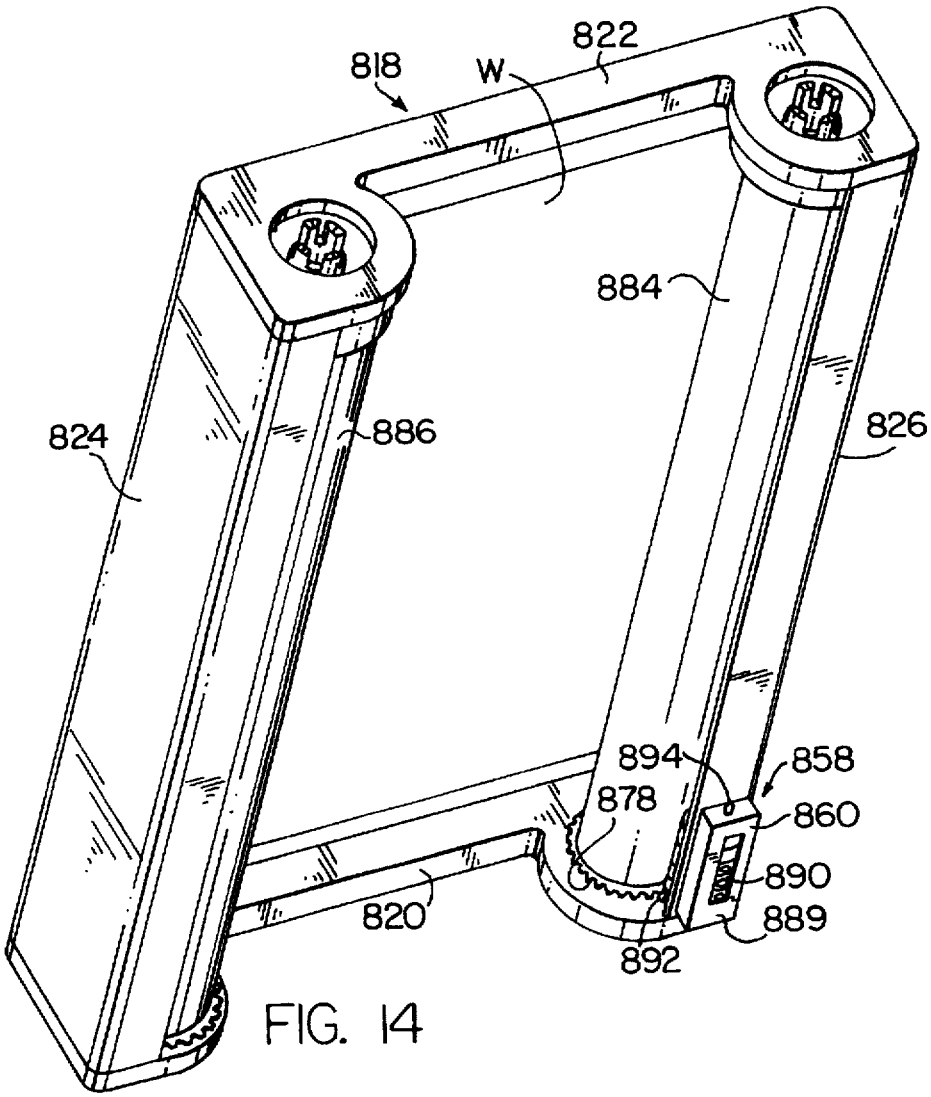
FIG. 14 is a perspective view of a fifth embodiment of a cassette of the present invention used in the printer of FIG. 2, including a reusable counter to indicate the length of unconsumed web in the cassette.
Figure 15:
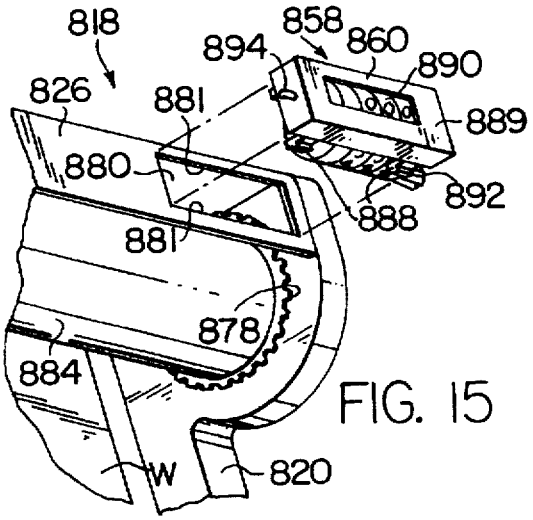
FIG. 15 is a fragmentary, perspective view of the cassette of FIG. 14, illustrating the reusable counter removed from the cassette, and a cutout in the cassette for receiving the counter.

Turning to FIGS. 14 and 15, still another embodiment of a cassette of the present invention is indicated generally by the reference numeral 818. The cassette 818 can be used within the printer 12 described above or like printing apparatus, and is the same in many respects as the cassettes described above. Accordingly, like reference numerals preceded by the numeral 8, instead of 2, 4 and 6, respectively, are generally used to indicate like elements. The cassette 818 differs from the cassettes described above in that the cassette includes a numerical counter for visually indicating the length of unconsumed web W, and that the counter can be removed from a used cassette, and reset and reused with another cassette. The characters on the counter may be visually read, and may also be machine readable.

A gear 878 is attached to one of the spools, and is preferably attached to one end of the supply spool 884. As shown in FIG. 15, a cutout 880 in the end shell 826 is defined by edges 881, 881 adjacent to the supply spool 884 and the supply spool gear 878. The indicating means, shown generally at 858, includes a counter 860 that is received and releasably held in the cutout 880 by four cantilever flanges 888 (two flanges are shown in FIG. 15) that extend from a counter housing 889. A read-out 890 is provided, and may be checked prior to a work operation to ensure that a cassette contains enough unconsumed web to complete the work operation. The counter 860 is removed from the cassettes, for example, by pressing opposite sides of the housing together to deflect the flanges 888 toward one another and withdrawing the counter from the opening. The counter 860 visually indicates information, such as the number of revolutions of material that have been unwound from the associated spool, e.g., the supply spool 884, which corresponds to an amount of unconsumed material remaining in the cassette.

The counter 860 is of a known type, such as model 7272/7287 made by Veeder-Root and sold by Danaher Controls of Gurnee, Ill., and includes a readout 890 which either directly shows the length of unconsumed web W remaining in the cassette, or may be used to determine indirectly the remaining unconsumed web. In FIG. 14, a counter gear 892 is coupled to the supply spool gear 878 when the counter 860 is installed in the cutout 880. The counter gear 892 rotates with the supply spool gear 878, e.g., during advancement of the web in a work operation, and the amount of unconsumed web material remaining in the cassette is visually displayed in the read-out 890. At such time as there is no unconsumed web remaining in the cassette 818, the counter 860 is removed as described above and reset using reset button 894, after which the counter may be inserted into and used with another cassette.

As noted above, the amount of material required for the work operation is determined in accordance with a printing program or other appropriate program. Prior to a work operation, the visually indicated information is manually entered into the printer via the control panel 36. Based upon the entered information and in a manner similar to that described above, the controller then determines whether there is enough unconsumed web in the cassette to complete a particular work operation, and thus whether the work operation should proceed. Where the counter includes machine readable characters as noted above, there is no need for an operator to manually enter the information.

From the foregoing, a novel method and apparatus for performing a work operation using a length of consumable web have been disclosed in some detail. However, as will be recognized by those skilled in the art, numerous modifications and substitutions can be made without departing from the spirit of the invention or the scope of the appended claims. Accordingly, the present invention has been described in several preferred embodiments by way of illustration rather than by limitation.

What is claimed is:

1. A machine for performing a work operation with a length of consumable web comprising:

a cassette comprises a casing and a spool rotatably mounted in the casing and containing a consumable web used during the work operation, one end of the consumable web is wrapped on the spool;

means for indicating a length of unconsumed web remaining in the cassette, the means for indicating being associated with the spool of the cassette;

means for reading the means for indicating to identify the length of unconsumed web in the cassette;

means for comparing the identified length of unconsumed web in the cassette with a predetermined length of unconsumed web required to perform the work operation;

means for performing the work operation including means for advancing the consumable web during the work operation when the means for comparing determines that the identified length of unconsumed web in the cassette is at least equal to the predetermined length of unconsumed web; and means for adjusting the means for indicating as the web is unwrapped from the spool, the means for adjusting being coupled to the means for indicating.

2. The machine as defined in claim 1 further comprising:

means for inhibiting the means for performing the work operation when the means for comparing determines that the identified length of unconsumed web remaining in the cassette is less than the predetermined length of unconsumed web.

3. The machine as defined in claim 1, wherein the means for performing the work operation comprise a printer for marking a sheet material.

4. The machine as defined in claim 1, wherein the means for adjusting comprises a first threaded member rotatably mounted in the casing and coupled to the spool, and wherein the means for indicating comprises a second threaded member coupled to the first threaded member, whereby the second threaded member moves axially along the first threaded member as the web is unwrapped from the spool.

5. The machine as defined in claim 4, wherein the means for indicating further comprises a pointer coupled to the second threaded member, and indicia located on the casing adjacent to the pointer.

6. The machine as defined in claim 1, wherein the means for indicating still further comprises electrically resistive means for indicating the amount of unconsumed web remaining in the cassette, the resistance of the electrically resistive means is adjusted as web is consumed during a work operation, the electrically resistive means being attached to the cassette so as to be electrically coupled to the means for reading when the cassette is mounted in the machine.

7. The machine as defined in claim 6, wherein the electrically resistive means are adhesively attached to the cassette.

8. The machine as defined in claim 6, wherein the electrically resistive means comprises at least one resistive strip, the resistive strip extending generally parallel to the spool on which the web is wound.

9. The machine as defined in claim 4, wherein the first threaded member comprises a lead screw.

10. The machine as defined in claim 5, wherein the indicia are also located adjacent to the first threaded member.

11. A cassette for use in a machine for performing a work operation requiring a predetermined length of consumable web comprising:

a casing;

a first spool rotatably mounted in the casing;

a consumable web including a length of unconsumed web and having a first end wrapped on the first spool;

means for indicating the length of unconsumed web wrapped on the first spool, the means for indicating being in operative engagement with and indicating the amount of rotation of the first spool; and means for adjusting the indicating means as the web is unwrapped from the first spool, the means for adjusting being coupled to the means for indicating.

12. The cassette of claim 11, wherein the means for adjusting comprises a worm gear coupled to the first spool, and wherein the indicating means comprises a threaded member coupled to the worm gear, whereby the worm gear and the threaded member move relative to each other as the first spool rotates.

13. The cassette of claim 12, wherein the means for indicating further comprises a pointer coupled to the threaded member and indicia cooperating with the pointer and graduated in predetermined units to indicate the length of unconsumed web wrapped on the first spool.

14. The cassette of claim 13, wherein the indicia is located on the casing and adjacent to the threaded member.

15. The cassette of claim 11, further comprising:

a second spool rotatably mounted in the casing in substantially parallel relationship with the first spool, whereby the other end of the consumable web is wrapped on the second spool so that the consumable web extends from the first spool to the second spool.

16. The cassette of claim 11, wherein the means for indicating are selectively removable from the cassette.

17. A method of performing a work operation requiring a known or predetermined length of unconsumed web material, the method comprising the steps of:

providing a machine for performing a work operation which consumes a length of web in the course of the work operation;

loading a cassette containing a consumable web into the machine for performing the work operation, the cassette having means for indicating the length of unconsumed web in the cassette;

reading the means for indicating to identify the length of unconsumed web in the cassette before the work operation is started;

comparing the identified length of unconsumed web with a predetermined length of unconsumed web required to perform the work operation;

performing the work operation if it is determined during the step of comparing that the length of unconsumed web is at least equal to the predetermined length of unconsumed web required to perform the work operation, and adjusting the means for indicating to reflect the length of unconsumed web remaining in the cassette when part of the length of the web is consumed by a work operation in order to indicate a new length of unconsumed web in the cassette.

18. The method of claim 17, further comprising the step of:

inhibiting the step of performing the work operation if it determined during the step of comparing that the length of unconsumed web is less than the predetermined length of unconsumed web.

19. The method of claim 17, further comprising the step of:

signaling an error condition if it is determined during the step of comparing that the length of unconsumed web is less than the predetermined length of unconsumed web.

20. The method of claim 17, wherein:

the step of adjusting occurs during the step of performing the work operation.

21. The method of claim 17, wherein:

the step of reading the means for indicating occurs during the step of loading.

22. The method of claim 17, wherein the step of providing includes providing a machine having a moveable sensor;

the step of loading includes loading a cassette having an indicating means comprising a pointer, the pointer being movable during a printing operation;; and the step of reading includes moving the sensor to the pointer to determine the position of the pointer.

23. The method of claim 22, wherein the sensor is moved from a reference point to the pointer during the step of moving, and the step of reading further includes measuring a distance between the reference point and the sensor and calculating the length of unconsumed web in the cassette from the measured distance.

* * * * *